United States Patent [19]

Plach

[11] 4,079,896

[45] Mar. 21, 1978

[54] EXPANDABLE CHUCK FOR WINDING WEB MATERIAL ON A CORE

[75] Inventor: Edward F. Plach, Appleton, Wis.

[73] Assignee: The Appleton Machine Company, Appleton, Wis.

[21] Appl. No.: 743,037

[22] Filed: Nov. 18, 1976

[51] Int. Cl.[2] ..... B65H 75/18

[52] U.S. Cl. ..... 242/72.1; 242/68.2

[58] Field of Search ..... 242/68.2, 72, 72.1; 279/2

[56] References Cited

U.S. PATENT DOCUMENTS

| | | | |
|---|---|---|---|
| 533,451 | 2/1895 | Farnsworth | 242/72.1 |
| 1,016,738 | 2/1912 | Curry | 242/72.1 |
| 1,525,751 | 2/1925 | Lamotte | 242/68.2 X |
| 2,113,701 | 4/1938 | Mayer | 242/68.2 |
| 2,942,892 | 6/1960 | Nelson | 242/72.1 |
| 2,952,418 | 9/1960 | Rice | 242/72.1 |
| 3,881,666 | 5/1975 | Greenhalgh | 242/72.1 |

*Primary Examiner*—Edward J. McCarthy
*Attorney, Agent, or Firm*—McDougall, Hersh & Scott

[57] ABSTRACT

An expandable chuck is attached to a rotating mandrel by means of a locking ring. The chuck includes arbor and shoe segments in camming relationship whereby relative movement is effective for increasing the effective diameter of the shoe segments. A core upon which a web material is to be wound is placed over the shoe segments which are then extended by rotation of an adjusting nut to secure the core to the shoe segments. For high torque applications a pair of chucks may be employed.

6 Claims, 4 Drawing Figures

EXPANDABLE CHUCK FOR WINDING WEB MATERIAL ON A CORE

BACKGROUND OF THE INVENTION

This invention relates to the field of winding machines. More specifically, it relates to devices for winding web materials on a hollow core of fiber or metal. Typically, such materials are wound onto or off of the core and then further processed. Winding the web material is accomplished by attaching the core to a rotating mandrel or shaft. In the past various means and techniques were employed for attaching the mandrel to the core. For example, the core was notched and the mandrel was provided with a raised pin which engaged the notch for insuring that the core rotated with the mandrel. Such constructions have the disadvantage of oftentimes damaging the core and interrupting the winding process when positive coupling is lost.

Accordingly, it is desirable to provide a means for securely locking the core to the mandrel during winding without damaging the core while at the same time permitting rapid release upon completion of the operation. The present invention is an expandable chuck which has a nominal diameter smaller than the core to be wound. The chuck is inserted into the end of the core and then is expanded to securely engage the inner circumference of the core to permit winding. This construction does not damage the core and permits quick coupling and uncoupling.

It is accordingly an object of the present invention to provide an expandable chuck for winding web material on a hollow core.

It is another object of the invention to provide a chuck which can be readily attached to a mandrel and which will secure a core thereto for rotation.

It is a further object of the invention to provide an expandable chuck to secure a core or tube to a rotating shaft.

Other objects and advantages of the invention will be apparent from the remaining portion of the specification.

DETAILED DESCRIPTION

Figure 2:
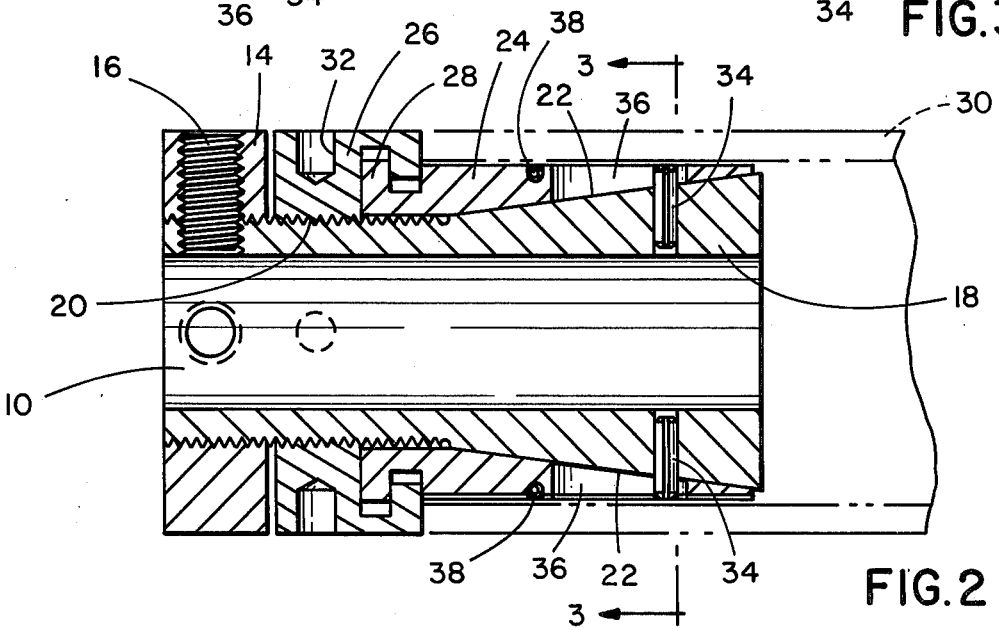
FIG. 2 is a sectional view through the chuck along the lines 2—2 of FIG. 1.
Figure 4:
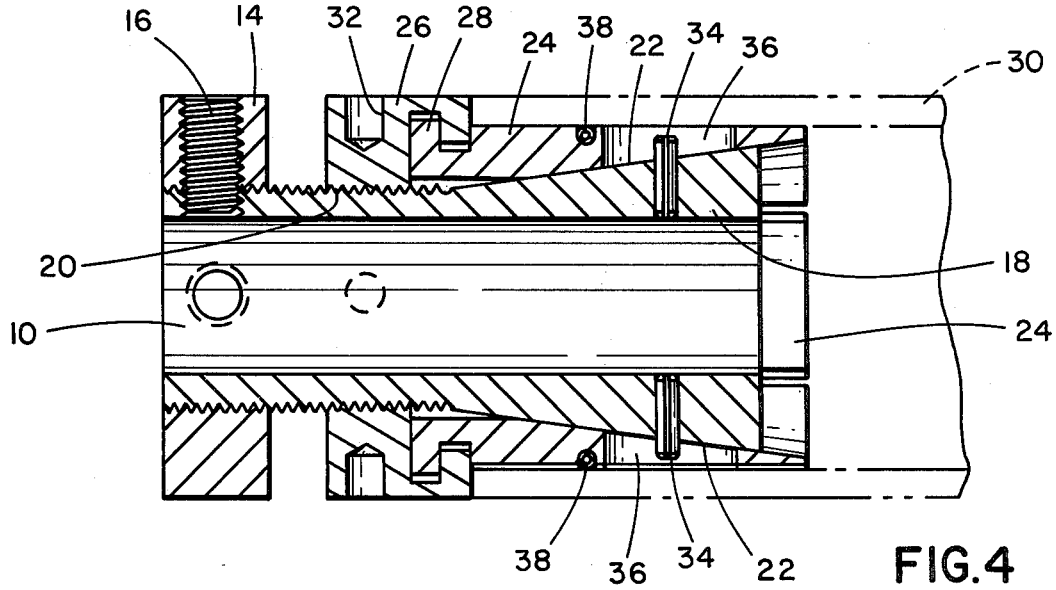
FIG. 4 is a view similar to FIG. 2 in which the core is engaged by the chuck.

Referring to the drawings, an expandable chuck according to the invention is illustrated. The chuck is intended for attachment to a rotating mandrel or shaft 10 at the end thereof. The chuck 12 is secured to the mandrel by means of a locking ring 14 having at least one set screw 16 provided therethrough. As indicated in FIGS. 2 and 4, the mandrel 10 is received in the hollow interior of the chuck at least past the locking ring and desirably to the end of the chuck. The set screws 16 are then tightened joining the chuck to the shaft for rotation therewith.

An arbor 18 of a tubular construction has an internal bore sufficient to receive a given mandrel. The outside circumference of the arbor consists of a threaded area

20 and a tapered area 22. The threaded area 20 has the locking ring 14 threaded thereon. Disposed over the tapered portion of the arbor are at least four segmented shoes 24. These shoe segments have an internal or inside taper complementary to the taper of arbor 18.

One end of each segment is engaged by an adjusting nut 26. Nut 26 is threadingly engaged on the threaded portion 20 of the arbor. Rotation of the adjustment nut is effective for moving the nut toward or away from the locking ring 16. The shoe segments 24 are secured to the adjustment nut by reciprocal L-shaped extentions 28 so that the shoe segments move with the adjusting nut.

The taper of the arbor and shoe segments is such that when the shoes are moved away from the locking ring, by rotation of the adjustment nut, the effective diameter of the chuck is uniformly increased. Thus, movement of the adjustment nut causes the shoe segments to move up or down the taper on the arbor to lock or unlock a hollow tubular core 30 into which the chuck is inserted.

This can be seen by comparing FIGS. 2 and 4. In FIG. 2 the core 30 is shown disposed over the shoe segment portion of the chuck. Note that the effective diameter of the chuck is less than the diameter of the core and, therefore, the core may be removed or placed over the chuck easily. In FIG. 4, however, by threading movement of the adjustment nut 26 away from the locking ring the shoe segments have been moved up the inclined arbor surface. The effective diameter of the chuck now is at least as great as the core inner diameter and the shoes firmly engage the core.

Figure 1:
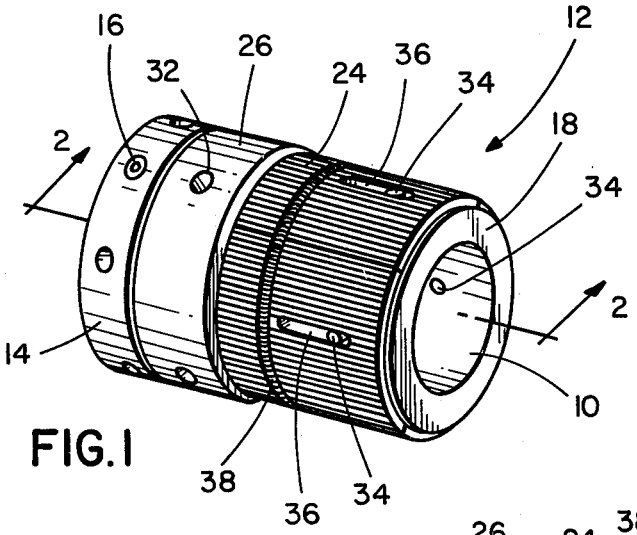
FIG. 1 is a perspective view of the expandable chuck according to the invention.
Figure 3:
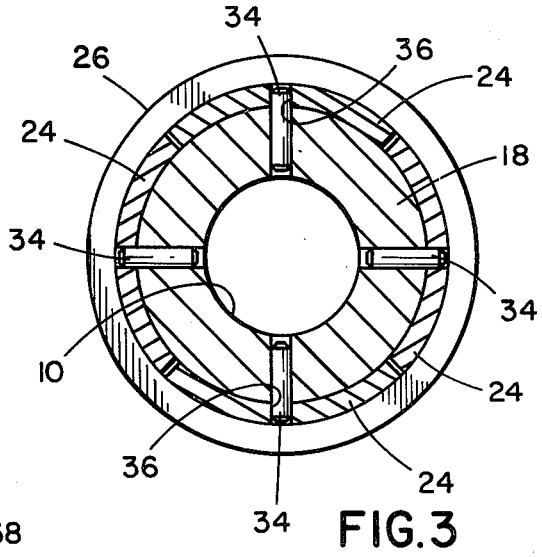
FIG. 3 is a sectional view along the lines 3—3 of FIG. 2.

In order to assure firm engagement between the core and the shoe segments the latter may have a grooved, ribbed or otherwise textured surface as indicated in FIG. 1. In order to insure that the adjustment nut does not move during winding operations, a plurality of sockets 32 are spaced around its circumference for receipt of a spanner or pin-type wrench. A similar provision is made in the locking ring whereby use of a pair of wrenches, one each in the adjustment nut and locking ring, permits a sufficient amount of force to be applied to the adjustment nut to secure it in a locked position during winding operations. A reverse operation with the wrenches will be effective for releasing the core 30 upon completion of winding or unwinding.

The shoe surface is formed in segments, as illustrated, for convenience in assembly and in servicing the device should that be needed. In order to prevent slippage between the arbor and the shoe segments, roll pins 34 are provided as a means of transmitting torque between the shoe segments and the arbor. In order to accommodate the lateral movement of the shoe segments, an elongated slot 36 is formed in each shoe segment to accommodate the roll pin.

During the time when the chuck is not inserted into a core there is a tendency for the shoe segments to move away from the arbor. To prevent this from occurring a spring 38 is provided around the periphery of the shoe segments. The spring may be of the usual coil type and the shoe segments may have an indentation for receipt of the spring.

The expandable chuck described herein may be used singly with a dummy support at the other end of a core where only low torques are required or, alternatively, a pair of such expandable chucks may be provided, one at each end of the core, where greater torque capability is required. While the chuck disclosed herein is intended for use with hollow cores for web winding it will be apparent that it may have additional applications. It can be used to rotate pipe or other hollow tubular members and conceivably could be employed as part of a power train arrangement for transmitting rotary motion.

While I have shown and described embodiments of this invention in some detail, it will be understood that this description and illustrations are offered merely by way of example, and that the invention is to be limited in scope only by the appended claims.

I claim:

1. A chuck for connecting a hollow cylindrical member to a shaft for rotation therewith comprising:

(a) an arbor having a tapered surface at one end thereof;

(b) locking means mounted on said arbor for securing said chuck to said shaft;

(c) a plurality of textured shoe segments having an inside surface tapered complementary to the taper of said arbor disposed over said one end of said arbor to form a cylindrical shell, said segments adapted to engage substantially the entire internal circumference of said cylindrical member and constituting the sole means of said engagement, (d) means for moving said shoe segments along the tapered surface of said arbor whereby the effective diameter of said shoe segments can be increased by movement in a first direction to engage said cylindrical member or decreased by movement in the opposite direction to disengage said member; and (e) means for transmitting torque from said arbor to each of said shoe segments.

2. The device according to claim 1 wherein said arbor is hollow and adapted to be concentrically mounted over said shaft.

3. The device according to claim 1 wherein said locking means includes a locking ring secured to said arbor at the other end thereof and at least one set screw provided through said ring for securing said chuck to said shaft.

4. The device according to claim 1 wherein said transmitting means are roll pins.

5. The device according to claim 1 wherein said means for moving includes an adjustment nut threadingly mounted to said arbor, said gripping means being attached to said nut for movement therewith.

6. The device according to claim 5 wherein said adjustment nut and said gripping means include means for interlocking said nut and said gripping means one to the other.

* * * * *